US006902698B2

(12) United States Patent
Rau et al.

(10) Patent No.: US 6,902,698 B2
(45) Date of Patent: Jun. 7, 2005

(54) PRESS APPARATUS FOR PRODUCING DIMENSIONALLY ACCURATE PRESSED ARTICLES FROM A POWDERED MATERIAL

(75) Inventors: Walter Rau, Grossweil (DE); Johann Meyer, Koenigsdorf (DE)

(73) Assignee: Dorst Technologies GmbH & Co. KG. (DE)

( * ) Notice: Subject to any disclaimer, the term of this patent is extended or adjusted under 35 U.S.C. 154(b) by 24 days.

(21) Appl. No.: 10/197,823

(22) Filed: Jul. 19, 2002

(65) Prior Publication Data

US 2003/0015813 A1 Jan. 23, 2003

(30) Foreign Application Priority Data

Jul. 20, 2001 (DE) ..... 101 35 523

(51) Int. Cl.[7] ..... B22F 3/02
(52) U.S. Cl. ..... 419/38; 425/78
(58) Field of Search ..... 425/78; 419/38

(56) References Cited

U.S. PATENT DOCUMENTS 4,392,800 A * 7/1983 Apuzzo ..... 425/78
4,482,307 A 11/1984 Schaidl et al.
5,043,111 A 8/1991 Hinzmann et al.

FOREIGN PATENT DOCUMENTS

DE 3142126 A1 5/1983
DE 3142126 11/1984
DE 4000423 7/1991
EP 0436792 7/1991

OTHER PUBLICATIONS

"Pulvermetallurgische Formgebung im Wandel" Pulvermettalurgie in Wissenschaft und Praxis Band 15, Symposium of Committee for Powder Metallurgy of the Association of German Iron Workers, Nov. 18–19, 1999, pp. 232–235.
Figure 1 of Document E1: Construction of a Multi–plate Adaptor, pp. 233.
"Pulvermetallurgische Formgebung im Wandel" Pulvermettalurgie in Wissenschaft und Praxis Band 15, Symposium of Committee for Powder Metallurgy of the Association of German Iron Workers, Nov. 18–19, 1999, pp. 59–67.

* cited by examiner

*Primary Examiner*—Daniel Jenkins
(74) *Attorney, Agent, or Firm*—Crowell & Moring, LLP

(57) ABSTRACT

A press apparatus for producing dimensionally accurate pressed articles from a particulate material including a frame (70, 73), which can be connected via respective lower and upper connecting devices (71, 72) to a lower and upper platens of a press, a die holding plate (5) arranged in the frame and preferably rigidly connected with the lower connecting device, in which the die holding plate is displaceable relative to a base body (0), a plurality of punch carriers (1–4), at least one of which is supported on the frame between the die holding plate and the base body so as to be displaceable relative thereto into charging and pressing positions by piston/cylinder drives, and supports (12, 22, 32, 42), which in the final press position support the punch carriers relative to the base body. The support of the punch carriers is improved by arranging the supports between the base body and the associated punch carriers such that in the final press position punches seated on the punch carriers are centrally supported in the line of the pressing force via the supports.

17 Claims, 5 Drawing Sheets

PRESS APPARATUS FOR PRODUCING DIMENSIONALLY ACCURATE PRESSED ARTICLES FROM A POWDERED MATERIAL

BACKGROUND OF THE INVENTION

This invention relates to a press apparatus for pressing dimensionally accurate pressed articles from a substantially powdered material.

Presses of this type generally serve to press powders or granulates of iron, ceramic constituents, or the like into pressed articles, e.g. gears or press-formed parts. The high specific pressing pressures, which may be as high as 30–100 $kN/cm^2$ and more, require a very high stability of the press apparatus.

Schaidl et al., U.S. Pat. No. 4,482,307 (=DE 31 42 126) discloses a modular press, which comprises the actual press for applying the main pressing force and a press apparatus that can be inserted like an adapter into this actual press. This insertable press apparatus comprises a tool frame, which is coupled between the two platens of the press via an upper and a lower connecting device. This adapter-like press apparatus essentially consists of a frame of pull rods for guiding a plurality of plates, punch carriers and a die plate located between the connecting devices, which are likewise arranged or supported on the frame. In this arrangement, a base plate comprising the hydraulic devices for the relative movement of the individual plates, which are configured as punch carriers, is supported in the actual press by a mounting attachment. The additional plates are supported in the frame such that they are displaceable relative to the base plate. The die mounting plate is rigidly connected with the lower connecting device of the adapter via the frame and is arranged in the frame such that it is displaceable relative to the upper connecting device of the adapter. The individual punch carriers can be hydraulically moved relative to the base plate, such that they can be displaced between a charging position in which the lower die opening of the die mounting plate can be filled with a powder, and a final press position in which the powder is pressed into a pressed article by the press punches. The punches for pressing the powder are seated on the respective punch carriers. In the final press position, the individual punch carriers are supported against fixed stops. Both the piston/cylinder devices for hydraulically driving the individual punch carriers and the fixed stops are arranged in the outer peripheral region of the punch carriers, spaced a distance from the respective central openings of the individual punch carriers. The central openings in the individual punch carriers are configured in such a way that each of the punches seated on one of the punch carriers that is further away from the die mounting plate can be guided through the openings of the punch plates that are closer to the die mounting plate.

To improve the guidance of the punch carriers, Fleissner et al., EP 436,792 (=DE 40 00 423) proposes a press for producing dimensionally accurate pressed articles from a powdered material. This press has an upper and a lower press platen and a tool frame that can be inserted like an adapter into the press. This tool frame can be connected to the lower platen via a lower coupling plate and to the upper platen via an upper connecting piece. On a base plate of the tool frame, which is firmly supported in the press, a displaceably supported frame of pull rods is arranged. These pull rods rigidly connect the lower coupling plate wit a die mounting plate. Furthermore, punch carriers can be moved from the base plate into the charging and pressing positions by piston/cylinder drives. To improve guidance, this publication proposes that the punch carriers be shaped as cups, which are guided along cylindrical surfaces relative to the base plate. In this arrangement, the punch carriers are also supported against fixed stops in the final press position.

Both of these arrangements require careful adjustment of the individual punch carriers relative to one another and relative to the frame in order to prevent tilting or uneven pressing. A particular problem is the position of the fixed stops, which especially for the third punch carrier from the base plate engage underneath the outer rim of the punch carrier far away from the central opening. In the final press position, this has the result that the corresponding punch carriers are supported along the outside against a fixed stop, while the inside of the punches adjacent the through opening is acted upon by an opposite pressing force. This causes deflection of the punch carrier, which must be compensated by adjusting the pressing forces, which in practice requires a large number of individual trials. For high press cycles, regular readjustment is additionally required, e.g. to compensate the influences of fluctuating powder qualities.

SUMMARY OF THE INVENTION

It is an object of the invention to provide an improved press for producing dimensionally accurate pressed articles from a powdered material.

Another object of the invention is to provide a press for producing dimensionally accurate pressed articles from a substantially powdered material in which deflection in the final press position is reduced even for punch carriers which are farther away from the base plate.

These and other objects are achieved in accordance with the present invention by providing a press apparatus for producing dimensionally accurate pressed articles from a particulate material, the apparatus comprising a frame which can be connected via a lower connecting device to a lower platen of a press and via an upper connecting device with an upper platen of the press, a die holding plate arranged in the frame, a base body arranged in the frame such that the die holding plate and the base body are displaceable relative to each other, a plurality of punch carriers, at least one of which is supported on the frame between the die holding plate and the base body so as to be displaceable relative to the die holding plate and the base body, the punch carriers being movable relative to the base body into charging and pressing positions by piston/cylinder drives, and support devices for supporting the punch carriers relative to the base body in a final press position, the support devices being arranged between the base body and the associated punch carriers such that in the final press position punches seated on the punch carriers are centrally supported by the support devices in the line of force of the press.

In accordance with a further aspect of the invention, the objects are achieved by providing a method for producing dimensionally accurate pressed articles from a substantially particulate material with a press apparatus comprising a frame for connecting a lower platen of a press via a lower connecting device and for connecting adapter-like an upper platen of the press via an upper connecting device, a die holding plate and a base body both arranged in the frame so as to be displaceable relative to one another, a plurality of punch carriers, at least one of which is supported on the frame between the die holding plate and the base body so as to be displaceable relative to the die holding plate and relative to the base body, support devices arranged between the base body and respective punch carriers for supporting the punch carriers relative to the base body during pressing in a final press position, and piston/cylinder drives for moving the punch carries relative to the base body during operation of the press into charging or pressing positions, the method comprising centrally supporting punches seated on the punch carriers in the final press position via the support devices along a line of force exerted by the press.

In accordance with yet another aspect of the invention, the objects are also achieved by providing a method for producing dimensionally accurate pressed articles from a substantially particulate material, using a press apparatus comprising a frame for connecting a lower platen of a press via a lower connecting device and for connecting adapter-like an upper platen of the press via an upper connecting device, a die holding plate and a base body arranged in the frame so as to be displaceable relative to one another, a plurality of punch carriers arranged between the die holding plate and the base body, at least one of the punch carriers being supported on the frame so as to be displaceable relative to the die holding plate and relative to the base body, support devices for supporting the punch carriers during pressing in the final press position relative to the base body, and at least one measuring device on at least one fixed punch carrier or support device for measuring compression during pressing, the method comprising moving the punch carriers relative to the base body between press charging and pressing positions during operation of the press by piston/cylinder drives, and monitoring operation of the press using the at least one measuring device, wherein the support devices are arranged between the base body and the associated punch carriers in such a way that during pressing in the final press position the punches attached to the punch carriers are centrally supported in the line of force via the support devices, so that the measured values measured by the at least one measuring device represents actual compression during pressing, and wherein the method further comprises controlling the pressing force during operation of the press in response to the measured values from the at least one measuring device.

As used herein, the term "dimensionally accurate" is intended to indicate improved dimensional accuracy, it being understood that absolutely perfect dimensional accuracy may not always be attainable.

As used herein, the term "particulate" is intended to cover powdered materials and granulates.

The central support of the punch carriers enables force transmission in the final press position in such a way that the punch carriers no longer bend. The line of force is guided equally, or at least substantially equally, in an extension of the support devices or fixed stops through the corresponding segments of the punch carriers, more or less in a direct line to the punches which press the powder or granulate in the die opening. Although the hydraulics for moving the individual punch carriers relative to the base body or the base plate still engage at the sides of the punch carriers, deflection of the punch carriers between the starting point of the piston rods and the central region with the punches no longer affects the actual height or orientation of the punch in the final press position.

Surprisingly, even centrally supported fixed stops or support devices offer sufficient stability to support the individual punch carriers in the final press position. In the best case, two support devices of small dimensions are sufficient to support the punch carriers that are located above them and equipped with punches arranged above or laterally above the support device, in order to provide good central force distribution. Thus, the support devices are advantageously arranged adjacent the central opening of a punch carrier.

In order to support the punch carriers at higher levels, the openings for passing through the support devices must be formed correspondingly in the lower lying punch carriers. Enlarged openings for the lower level punches, center pins, and the like can also be used to guide support devices through their peripheral region. The smaller the opening areas in the punch carriers for passing through the support devices, the better the stability offered for the individual punch carriers. Conversely, wider openings for passing through the support devices permit the passage of a plurality of support devices and particularly also the selective use of several support devices in initial press trials. It is also possible, however, to provide separate openings for the passage of support devices through a punch carrier. Such openings are less detrimental with respect to the stability of a punch carrier. In addition, once the fixed stop has been guided through or inserted, or the support device has been inserted, the opening offers further support for the guidance of the punch carrier.

For punch carriers that carry only small punches on their surface, it is useful if the attachment devices which project into the central opening of the punch carrier in order to attach the punches and under which the support devices engage, have correspondingly small dimensions. In these cases, the hydraulic devices are advantageously arranged in an extension of the attachment devices starting from the center of the central openings.

The better the cross section of the support devices is adapted to the cross sectional form of the punches arranged above them, the better the pressing force can be transmitted directly in the line of force to avoid deflections in the relevant area of the punch carriers.

According to a less preferred but perfectly feasible embodiment, it is also possible to provide combined support devices with a multistage configuration on which several nested punch carriers rest at correspondingly different levels in the final press position.

BRIEF DESCRIPTION OF THE DRAWINGS

The invention will be described in further detail hereinafter with reference to illustrative preferred embodiments shown in the accompanying drawings, in which.

DETAILED DESCRIPTION OF PREFERRED EMBODIMENTS

Figure 1:
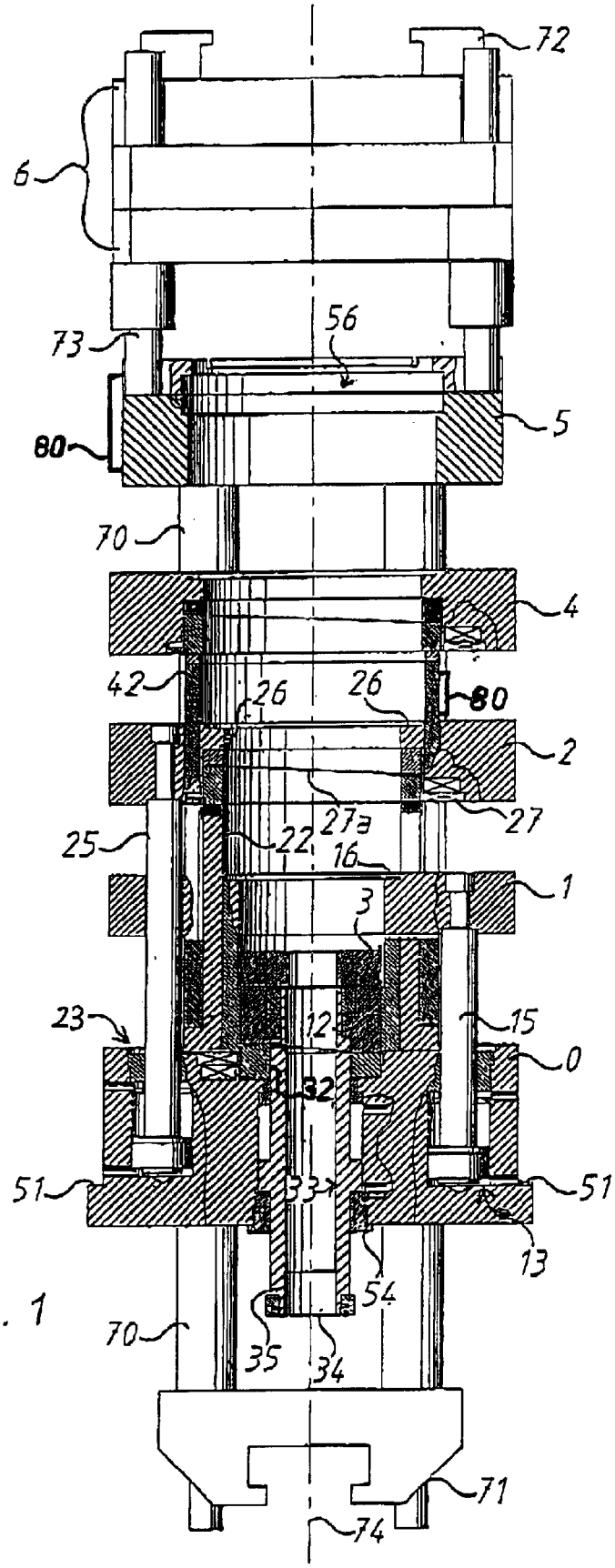
FIG. 1 is a lateral cross section of a press apparatus for producing dimensionally accurate pressed articles from a powdered material.

As can be seen from the figures, a press apparatus for pressing dimensionally accurate pressed articles from powdered or granulated material, particularly from iron powder, ceramic powder or the like, comprises a plurality of subassemblies. These are, essentially, a lower press block formed by a base plate 0, punch carriers 1, 2, 3 and 4, a die mounting plate 5 and a lower connecting device 71, and an upper press block 6, which are arranged one above the other in a frame of pull rods 70 and the like. The upper press block 6 preferably comprises components comparable to those of the lower press block. The upper press block 6 can be formed, for instance by an upper connecting device 72, an upper base plate and die carriers.

The lower connecting device 71 has a coupling device for coupling to a lower press platen of a hydraulic press or the like, The upper press block 6 has a corresponding upper connecting device 72 with a coupling device for coupling to an upper press platen. Advantageously, such an arrangement with connecting devices 71, 72 forms an adapter 7, which can be prepared and equipped as a tool carrier for the corresponding purpose outside a press and subsequently installed in the press in only a few work steps. This results in correspondingly short downtimes for the actual press.

Guide rods 73, which are arranged in extension of pull rods 70 of the frame serve to connect the lower press block and the upper press block 6. The frame thus holds together all the individual components of adapter 7. Guide rods 73 between the two press blocks are not necessarily required, however.

Figure 2:
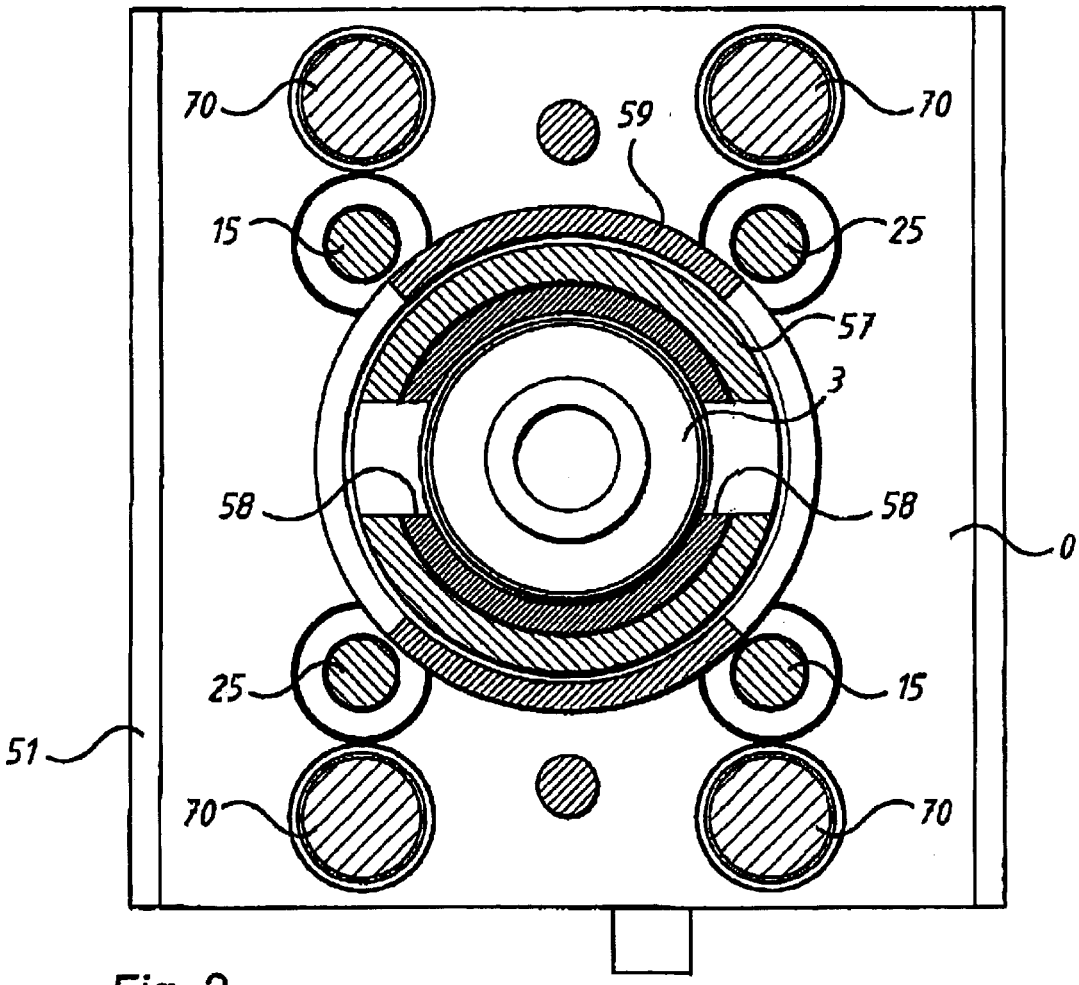
FIG. 2 is a top view of a base plate of the press apparatus of FIG. 1 with indicated support surfaces for support devices.

After installation of the press apparatus or adapter 7 in a press, the lower connecting device 71 is coupled with the lower platen of the press. Base plate 0, a top view of which is shown in FIG. 2, is arranged above the lower connecting device 71 via pull rods 70, four of which preferably extend through the four corner areas of the lower connecting device 71. Alternatively, it is of course also possible to use more or fewer pull rods, e.g. only one or two.

In the present example, base plate 0 has a rectangular outer configuration, and the four pull rods 70 pass through corresponding openings in its corner areas. On two sides, base plate 0 is equipped with a respective bearing attachment 51 by which the base plate 0 after installation is firmly connected to the press, or is at least firmly supported therein.

Base plate 0 serves as a bearing arrangement for the plurality of die carriers 1–4, which in this case are depicted as essentially plate-shaped components. The individual punch carriers 1–4 can be moved relative to base plate 0 by hydraulic devices. Furthermore, fixed stops 12, 22, 32, 42 extend from base plate 0 in the direction of the individual punch carriers 1–4. In the final press position, punch carriers 1–4 rest against the fixed stops 12, 22, 32 or 42 that are respectively associated with them. Fixed stops 12, 22, 42 preferably rest on bearing surfaces 57–59.

In the present example, the innermost punch carrier 3, which in this case is arranged, for instance, radially uniformly around a central press axis 74, is centered on or in base plate 0. A piston/cylinder arrangement 33 for moving the innermost punch carrier 3 relative to base plate 0 is arranged in the area of a central opening 54 passing through base plate 0. This enables a pressure-actuated displacement of the innermost punch carrier 3 in the direction of the central press axis 74.

In the embodiment shown, piston rod 35 of piston/cylinder arrangement 33 for the innermost punch carrier 3 has a central opening 34 trough which a center pin or other components can be guided through innermost punch carrier 3 in the direction of central press axis 74.

Figure 3:
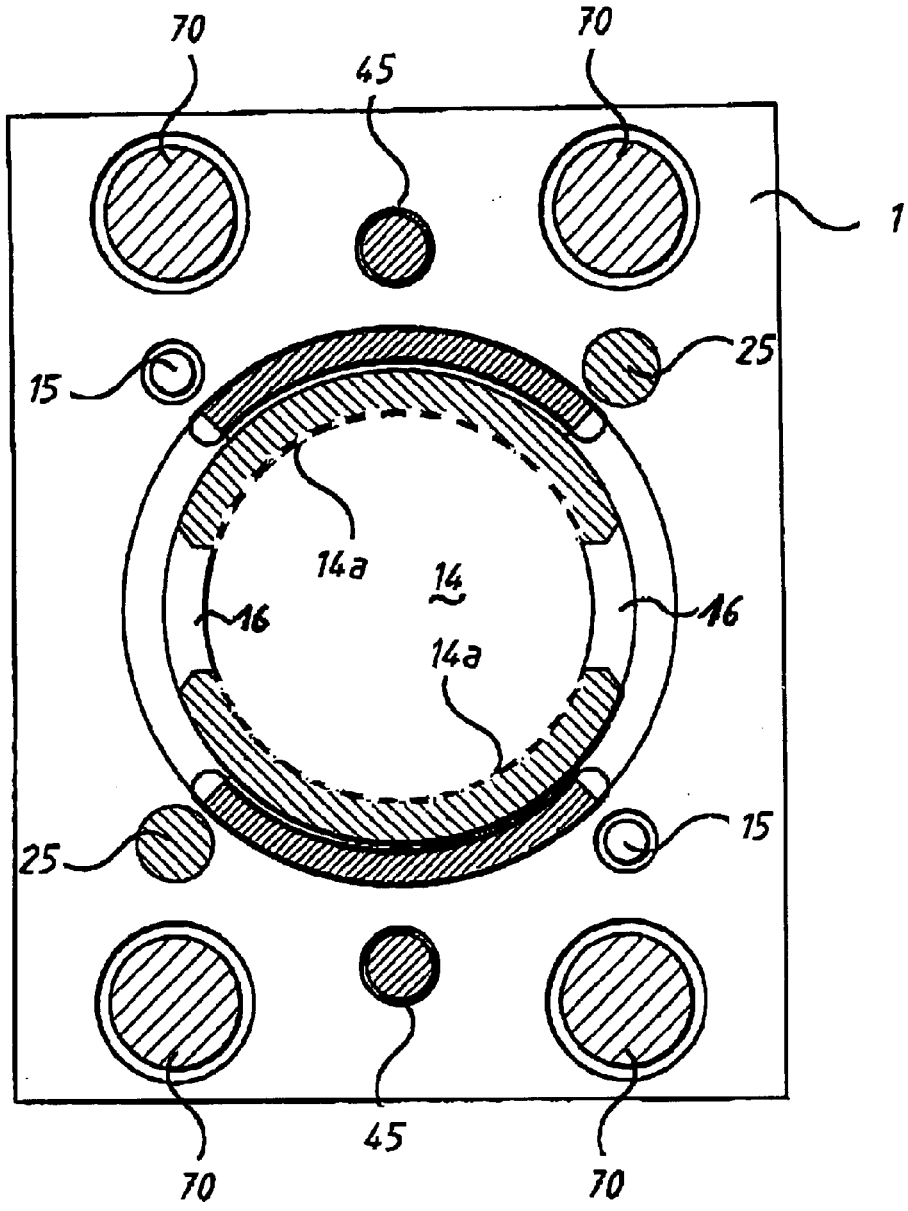
FIG. 3 is a top view of a first punch carrier above the base plate.

A first punch carrier 1 is arranged adjacent in radial and axial direction to the innermost punch carrier 3. While the innermost punch carrier 3 in this embodiment is entirely supported and guided by base plate 0, the first punch carrier, which is also square in top view, as may be seen in FIG. 3, is provided with bores in its corner regions through which the four pull rods 70 of the frame are guided. This serves to support the first punch carrier 1 in such a way that it is displaceable only in the direction of the central press axis 74. To move the first punch carrier 1 in the direction of the central press axis 74, one or more (in this case two diametrically opposite) piston/cylinder arrangements 13 are disposed in base plate 0. Alternatively, the piston/cylinder arrangements can also be arranged and/or fixed, for instance, on or under the base plate. From the corresponding cylinder chambers, which have associated hydraulic connections, a respective piston rod 15 projects through the surface of base plate 0 and toward the underside of the first punch carrier 1. The piston rods 15 are fixed in the first punch carrier 1 in such a way that the punch carrier can be hydraulically moved upward and downward relative to base plate 0. To guide the punch, which in operation is carried on the surface of the innermost punch carrier 3 through the first punch carrier, the first punch carrier is provided with a central opening 14.

The fixed stop or stops 12 for supporting the first punch carrier 1 in the final press position are arranged on base plate 0 directly adjacent the location hole and guiding device for the innermost punch carrier 3. Thus, in the final press position, the fixed stop or stops 12 for the first punch carrier 1 are located below what is the inner area of punch carrier 1 relative to opening 14 and consequently lie in the effective direction of the line of the pressing force.

To simplify the illustration, only one insertion or seating device 16 for the punches of the first punch carrier 1 is shown. This insertion or seating device 16 for punches projects into opening 14 of the first punch carrier 1. The width of seating device 16 is sufficient to provide enough support for the mounted punches and, in addition, to sit securely on the fixed stops 12 for the first punch carrier 1.

Opening 14 of the first punch carrier 1 thus comprises a first central opening section through which punches seated on the innermost punch carrier 3 can be guided and an outer annular section 14*a* through which the fixed stops for supporting additional punch carriers 2, 4 of higher level components are guided. Depending on the requirements to be met by the punches on the first punch carrier 1, other additional or narrower or wider fixed stops 12 or attachment devices 16 can be formed for the first punch carrier 1.

In the present embodiment, the next press section is the second punch carrier 2, which in FIG. 1 is arranged above the first punch carrier 1. As can be seen from FIG. 4, the configuration of this second punch carrier 2 is substantially comparable to that of the first punch carrier 1. For instance, the second punch carrier 2 is also guided by the four pull rods 70, which pass through corresponding openings in its outer peripheral region. To lift or lower it, the second punch carrier 2 is also connected with a piston rod 25 of a piston/cylinder arrangement 23 for the second punch carrier 2, which is arranged in base plate 0. Furthermore, the second punch carrier 2 has a central opening 24 for passing through punches and the like that are carried on the first punch carrier 1, the innermost punch carrier 3, or as a center pin, in the final press position.

Advantageously, the second punch carrier 2 is equipped with a height adjustment device 27. In this respect, a height adjustment device, which is known per so from German Patent Specification DE 40 00 423 C2, may be used. This device comprises an adjustment ring 27*a* having a slanted lower face that tests on the fixed stop or stops 22 for the second punch carrier 2. By rotating the adjustment ring 27*a* about the central press axis 74 with the aid of a crank drive or the like, the height of the second punch carrier 2 in the final press position is adjusted relative to base plate 0.

Figure 4:
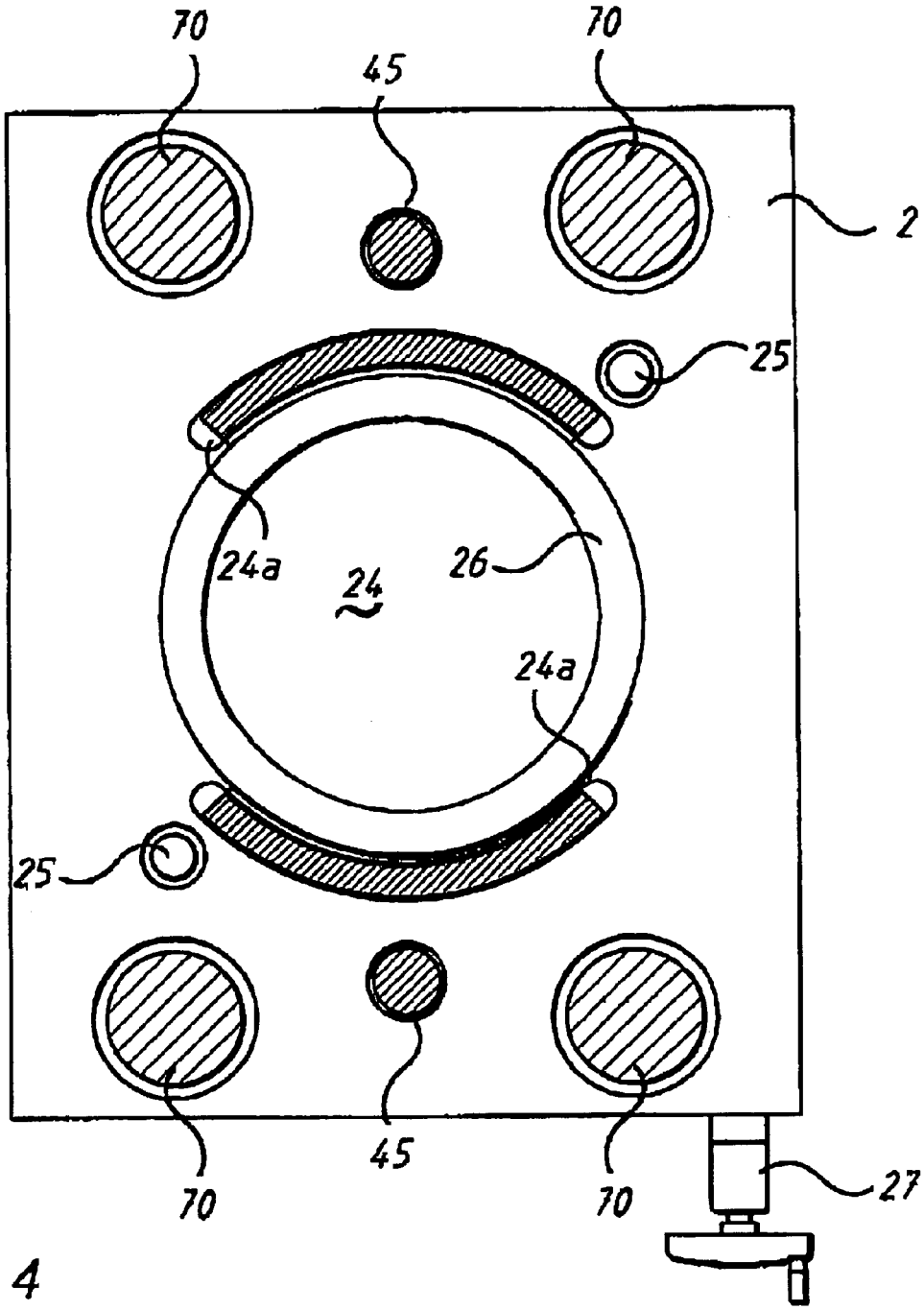
FIG. 4 shows a second punch carrier above the first punch carrier, both of which are provided with passages for punches etc. of lower level punch carriers.
Figure 5:
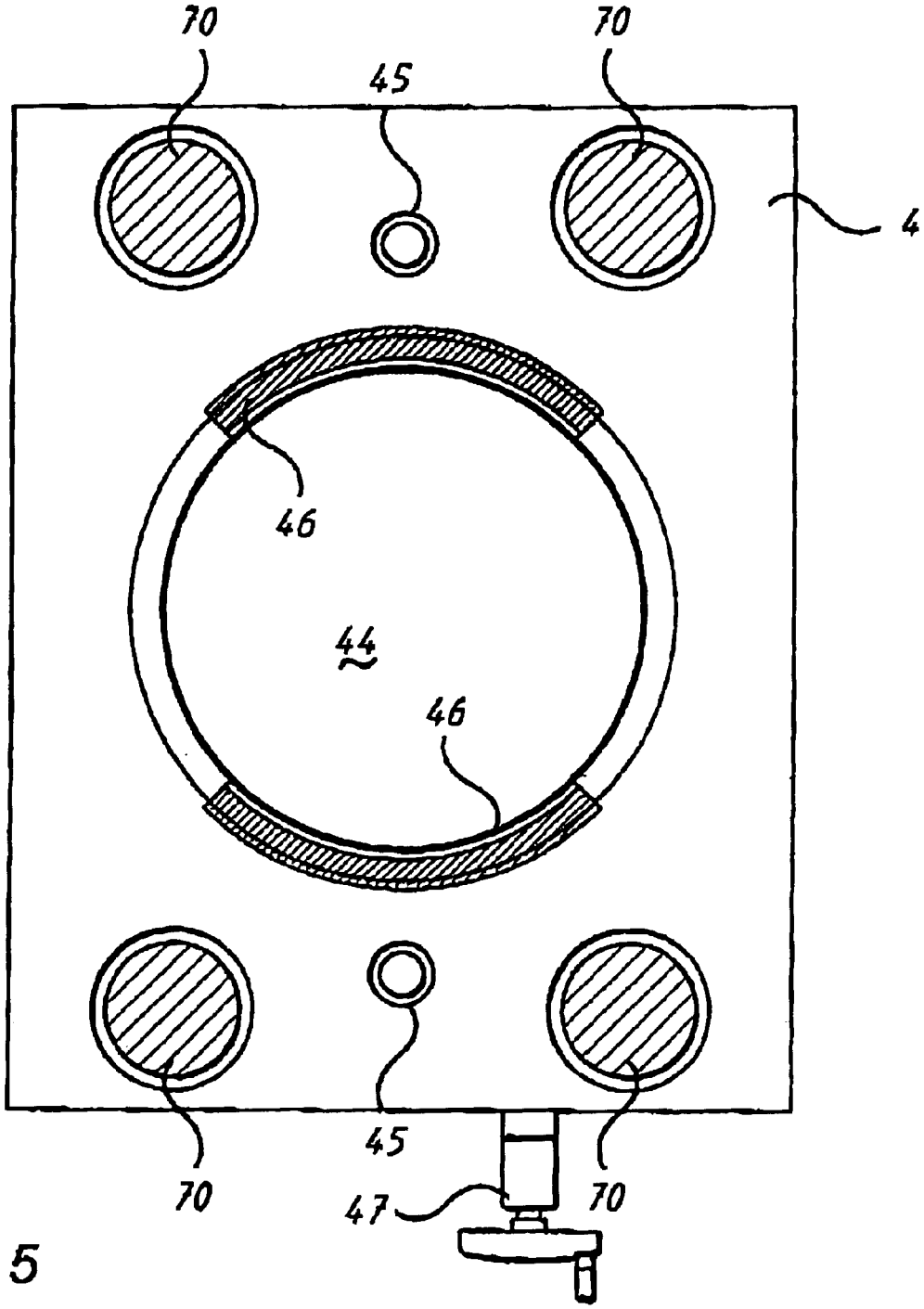
FIG. 5 shows a further punch carrier arranged above the aforementioned punch carriers.

As can be seen from FIG. 4, the seating device 26 of the second punch carrier 2 in this example comprises a closed annular component. The punches can thus be mounted seated on the fill circumference of the seating device 26. Fixed stops 22 are again arranged on base plate 0 in such a way that they engage underneath the punches below seating device 26 in the effective direction, particularly in the line of the pressing force. The arrangement of fixed stops 22 is selected such that they engage underneath seating device 26 as closely as possible to central opening 24.

In the present embodiment, an additional component, i.e., a fourth punch carrier 4, is arranged above the second punch carrier 2. The configuration of punch carrier 4 is similar to that of the above described punch carriers 1, 2. In its outer peripheral region, the fourth punch carrier 4 is again provided with passages for pull rods 70. To lift or lower the fourth punch carrier relative to base plate 0, one or more (in this case two) piston/cylinder arrangements are again provided, whose cylinders are arranged in base plate 0. The piston rod 45 passes through corresponding openings in base plate 0, the first punch carrier 1 and the second punch carrier 2 up to the fourth punch carrier 4. The fourth punch carrier 4 is also provided with a central opening 44, which serves for the passage of the punches etc. of the lower lying punch carriers. The inner peripheral region of the fourth punch carrier 4 is also configured as a seating device 46, the upper side being configured to receive punches, while the lower side is configured to set the fourth punch carrier 4 on one or more corresponding fixed stops 42. Fixed stops 42 are arranged on base plate 0 in such a way that they extend from the base plate through the first and the second punch carriers 1 and 2 up to the underside of the fourth punch carrier 4, where they are arranged underneath the punches seated thereon in the effective direction of the pressing force.

In the present embodiment, the fourth punch carrier 4 also is provided with a height adjustment device 47 for adjusting its height relative to base plate 0. Such height adjustment devices can be optionally provided or omitted for the individual punch carriers.

In the present example, the through-openings 14*a*, 24*a* for guiding the fixed stops 22 or 42 through the first punch carrier 1 or the second punch carrier 2 are configured differently to illustrate the variety of possible opening arrangements.

Thus, in the first punch carrier, the seating devices 16 for the punches of the first punch carrier 1 project into a large central opening 14 from the sides, such that annular opening extensions 14*a* are formed in the opening's edge regions, through which the corresponding fixed stops 22, 42 can be guided. To increase the stability or enlarge the contact surface for the fixed stops for the first punch carrier 1, the circumference of the lateral opening 14*a* can decrease in steps. In the present embodiment, the opening through which the fixed stops 22 for the second punch carrier 2 pass is therefore larger than the opening through which the fixed stops 42 for the fourth punch carrier 4 pass. Advantageously, the base for arranging the corresponding fixed stops may be annular. In alternative arrangements, however, it would also be possible to arrange fixed stops for different punch carriers adjacent to one another on a single annular base on base plate 0 if the respective lower punch carriers have to carry punches only in correspondingly narrow areas, and corresponding seating devices then project into a central opening similarly to the first punch carrier.

The second punch carrier 2 illustrates another possible arrangement of the openings for fixed stops 42. The central opening 24 is surrounded by a circumferential annular seating device 26, such that a plurality of or appropriately semicircular fixed stops 22 can engage underneath the seating device 26. To guide fixed stops 42 through the second punch carrier 2, openings 24*a* are formed outside the annular seating device 26. These openings are advantageously formed in an area below a corresponding seating device 46 of the fourth punch carrier 4. This again permits an arrangement of the fixed stops 42 in the effective direction of the pressing force with respect to the punches on the fourth punch carrier 4.

Above the fourth punch carrier 4, the next component is die mounting plate 5, which is rigidly connected with the lower connecting device 71 via pull rods 70. Additional components of upper press block 6 are arranged in extension of and above die mounting plate 5, e.g. via guide rods 73. These components can essentially be a mirror image of the described configuration of the lower press block. The upper connecting device 72 is movable relative to die mounting plate 5 via guide rods 73. A fixed connection of guide rods 73 with die mounting plate 5 is also possible, however. In this case, the entire upper assembly, including the upper connecting device 72 is displaceable relative to die mounting plate 5 via guide rods 73.

During a press cycle, in a first step, die 5 is moved upwardly relative to base plate 0 and punch carriers 1–4 of the lower press block. The punches mounted on punch carriers 1–4 and optionally also the center pin from die opening 56 are likewise moved partially upwardly, but not as far as the die, such that a die opening 56 is formed into which the powder can be filled from above. For the filling operation, a powder feed shoe is guided between the die and upper press block 6. After the powder or granulate has been filled into the die opening and the powder feed shoe has been retracted, the entire press apparatus is clamped. Die mounting plate 5 with upper press block 6 is pressed from above against base plate 0. The individual punch carriers 1–4 with the mounted punches are thereby pressed against die mounting plate 5, and the dies compress the powder inside die opening 56 into a pressed article.

After releasing the press and lifting the upper press block 6, the pressed article can be conveyed upwardly out of the die opening by further lifting one or more punch carriers 1–4 and thus driving up one or more of the punches seated thereon. Following removal of the pressed article by a robot or by the feed shoe moving into the opening above die mounting plate 5, the individual punch carriers 1–4 of the lower press block can be returned to the position for filling die opening 56.

A special feature of the press apparatus is the punch carriers 1–4, which are centrally supported by the associated fixed stops 12, 22, 32, 42. This central support in the final press position enables the pressing force to be exerted in the effective direction, particularly in the line of force of all the individual punches, such that deflection of the individual punch carriers toward their central opening can be minimized or avoided altogether.

While the above description was given for fixed stops 12, 22, 32, 42, each of which rests on, or is arranged in, base plate 0, other arrangements are also feasible, For instance, a portion of the fixed stops can also rest on other punch carriers, e.g. the fixed stops of the fourth punch carrier 4 can rest on or in the second punch carrier. As a result, no corresponding openings for the passage of these fixed stops for the fourth punch carrier need to be formed in the second and the lower punch carriers. Support in the line of force is nevertheless possible if the fixed stops for the second punch carrier are arranged on the second punch carrier in the line of force below the support point of the fixed stops for the fourth punch carrier.

The support devices described above are generally two symmetrical fixed stops arranged around the central opening or within the central opening. Other embodiments are also feasible, however. For instance, only a single fixed stop can be used per punch carrier. This stop can have very small dimensions, but can extend, for instance, perfectly circularly or cylindrically or almost cylindrically. It is also possible to use more than two fixed stops per punch carrier. The larger and the more distributed the contact surface on the fixed stops, the more uniformly distributed are the forces acting during the pressing process.

Additional advantageous variants are obtained through different fastening and supporting of the individual components to or relative to one another. While the die holding plate described above is firmly or rigidly connected with the lower connecting device and the base plate and the punch carriers can be displaced relative thereto, another relative arrangement can also be selected. For example, according to an alternative conventionally used by the person skilled in the art, the base body can be rigidly connected to the connecting device and the die holding plate can be supported so as to be displaceable relative thereto.

According to a further embodiment, which has independent inventive significance, it is also advantageous to arrange strain or compression gauges 80 on the fixed stops and/or the punch carriers. With these measuring devices, the actual buckling during pressing can be determined in order to control or regulate a correction of the pressing force and/or the adjustment of the height adjustment devices of the individual punch carriers. This also makes it possible to check for consistent powder quality, e.g. regarding changes in the powder charge used. Supporting the punches in the line of force makes such a measuring method meaningful in contrast to earlier arrangements, since the former bending effects of the punch carriers distorting the measurements are negligible in the above concept.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A press apparatus for producing dimensionally accurate pressed articles from a particulate material, said apparatus comprising:

a frame which can be connected via a lower connecting device to a lower platen of a press and via an upper connecting device with an upper platen of the press;

a die holding plate arranged in said frame;

a base body arranged in said frame such that the die holding plate and the base body are displaceable relative to each other;

a plurality of punch carriers, at least one of which is supported on the frame between the die holding plate and the base body so as to be displaceable relative to the die holding plate and the base body, said punch carriers being movable relative to the base body into charging and pressing positions by piston/cylinder drives, and support devices for supporting the punch carriers relative to the base body in a final press position, said support devices being arranged between the base body and the associated punch carriers such that in the final press position punches seated on the punch carriers are centrally supported by the support devices in the line of force of the press, wherein at least one support device for an upper punch carrier is supported on an intermediate punch carrier arranged between said upper punch carrier and said base body.

2. A press apparatus according to claim 1, wherein at least some of said support devices are arranged as fixed stops on the base body.

3. A press apparatus according to claim 1, wherein a support device comprising at least one fixed stop is provided for each punch carrier.

4. A press apparatus according to claim 1, wherein the support devices are centrally arranged underneath the respective punch carriers adjacent a central opening of the punch carrier, and punches are seated on the respective punch carriers overlying the support devices.

5. A press apparatus according to claim 1, wherein a central opening of at least one punch carrier is configured such that a pressing punch can pass centrally through said opening and such that support devices for an overlying punch carrier can pass through an outer peripheral region between said at least one punch carrier and the die holding plate.

6. A press apparatus according to claim 1, wherein at least one punch carrier comprises a central opening through which a punch can pass and at least one separate opening through which a support device for an overlying punch carrier arranged between said at least one punch carrier and the die holding plate can pass.

7. A press apparatus according to claim 6, wherein said at least one separate opening is separated from the central opening by a seating area for seating a punch to be carried by said at least one punch carrier.

8. A press apparatus according to claim 7, wherein said seating area has a width equal to that of the punch to be carried on said at least one punch carrier.

9. A press apparatus according to claim 1, wherein at least one punch carrier comprises a central opening and at least one seating device for seating a punch on said at least one punch carrier, said seating device projecting into said central opening, and said seating device being engaged from underneath by a support device for said at least one punch carrier.

10. A press apparatus according to claim 1, wherein said support devices comprise semi-cylindrical stop members.

11. A press apparatus according to claim 1, wherein said support devices each have a cross section corresponding in configuration to the punches arranged above them.

12. A press apparatus for producing dimensionally accurate pressed articles from a particulate material, said apparatus comprising:

a frame which can be connected via a lower connecting device to a lower platen of a press and via an upper connecting device with an upper platen of the press;

a die holding plate arranged in said frame;

a base body arranged in said frame such that the die holding plate and the base body are displaceable relative to each other;

a plurality of punch carriers, at least one of which is supported on the frame between the die holding plate and the base body so as to be displaceable relative to the die holding plate and the base body, said punch carriers being movable relative to the base body into charging and pressing positions by piston/cylinder drives, and support devices for supporting the punch carriers relative to the base body in a final press position, said support devices being arranged between the base body and the associated punch carriers such that in the final press position punches seated on the punch carriers are centrally supported by the support devices in the line of force of the press, wherein said support devices are configured with upper and lower stepped surface heights relative to at least two punch carriers, and wherein in the final press position one of the at least two punch carriers that is arranged further away from the die holding plate is supported on the lower stepped surface of the support device, and the other of the at least two punch carriers that is arranged closer to the die holding plate is supported on the higher stepped surface of the support device.

13. A press apparatus according to claim 1, further comprising at least one compression gauge affixed to at least one of said support devices for measuring deflection of the punch carrier supported by said at least one support device.

14. A method for producing dimensionally accurate pressed articles from a substantially particulate material, using a press apparatus comprising:

a frame for connecting a lower platen of a press via a lower connecting device and for connecting adapter-like an upper platen of the press via an upper connecting device;

a die holding plate and a base body arranged in said frame so as to be displaceable relative to one another;

a plurality of punch carriers arranged between the die holding plate and the base body, at least one of said punch carriers being supported on said frame so as to be displaceable relative to the die holding plate and relative to the base body;

support devices for supporting the punch carriers during pressing in the final press position relative to the base body, and at least one measuring device on at least one fixed punch carrier or support device for measuring compression during pressing;

said method comprising:

moving the punch carriers relative to the base body between press charging and pressing positions during operation of the press by piston/cylinder drives, and monitoring operation of the press using said at least one measuring device;

wherein the support devices are arranged between the base body and the associated punch carriers in such a way that during pressing in the final press position the punches attached to the punch carriers are centrally supported in the line of force via the support devices, so that the measured values measured by said at least one measuring device represents actual compression during pressing, and said method further comprises controlling the pressing force during operation of the press in response to the measured values from said at least one measuring device.

15. A method according to claim 14, further comprising adjusting the height of individual punch carriers in response to measured values from said at least one measuring device.

16. A method according to claim 14, wherein said powdered material is iron powder or ceramic powder.

17. A method according to claim 14, wherein said support devices comprise fixed stops.

* * * * *